United States Patent [19]

Sendzimir

[11] Patent Number: 4,603,569

[45] Date of Patent: Aug. 5, 1986

[54] PRESSURE CONTROLLED PLATE MILL

[76] Inventor: Tadeusz Sendzimir, P.O. Box 1350, Waterbury, Conn. 06720

[21] Appl. No.: 734,469

[22] Filed: May 15, 1985

Related U.S. Application Data

[63] Continuation-in-part of Ser. No. 632,953, Jul. 20, 1984, abandoned.

[51] Int. Cl.[4] ..... B21B 13/14; B21B 29/00; B21B 31/32; B21B 35/08

[52] U.S. Cl. ..... 72/245; 72/20; 72/205; 72/229; 72/234; 72/237; 72/242; 72/243; 72/249

[58] Field of Search ..... 72/245, 242, 243, 20, 72/199, 365, 366, 241, 249, 234, 229, 237, 205

[56] References Cited

U.S. PATENT DOCUMENTS

| | | | |
|---|---|---|---|
| 2,044,545 | 6/1936 | Roemer | 72/229 |
| 3,478,559 | 11/1969 | Polakowski | 72/242 |
| 3,596,489 | 8/1971 | Ball | 72/245 |
| 3,762,202 | 10/1973 | Sherwood | 72/245 |
| 3,766,767 | 10/1973 | Rastelli | 72/249 |
| 3,962,894 | 6/1976 | Noe et al. | 72/205 X |
| 4,041,752 | 8/1977 | Dolenc et al. | 72/245 X |
| 4,522,050 | 6/1985 | Thomas | 72/234 X |

FOREIGN PATENT DOCUMENTS

| | | | |
|---|---|---|---|
| 2547490 | 4/1977 | Fed. Rep. of Germany | 72/241 |
| 0429859 | 5/1974 | U.S.S.R. | 72/242 |

*Primary Examiner*—Francis S. Husar
*Assistant Examiner*—Steve Katz
*Attorney, Agent, or Firm*—Frost & Jacobs

[57] ABSTRACT

A mill and a method for rolling flat workpieces of great width such as metallic strip, plates and the like. The mill comprises upper and lower housing beams joined at their ends by pairs of channels defining windows in which chocks are slidably mounted. Upper and lower work rolls are mounted in the chocks to maintain the work rolls in the vertical plane of symmetry of the mill. Each work roll is provided with a plurality of pressure transmitting elements evenly spaced therealong and contacting a part of the periphery of the work roll. The set of pressure transmitting elements for the upper work roll is operatively affixed to the upper housing beam and the set of pressure transmitting elements for the lower work roll is operatively affixed to the lower housing beam. The pressure transmitting elements of at least one of the sets are each provided with a fluid pressure actuator by which the pressure exerted by that pressure transmitting element on its respective work roll can be rapidly increased or decreased. In the rolling procedure, the pressure transmitting elements are employed to absorb the roll separating force and produce a flat product. Those pressure transmitting elements provided with a fluid pressure actuator are constantly adjusted to maintain a constant rate of percentage of reduction of thickness of the workpiece across its width.

19 Claims, 18 Drawing Figures

PRESSURE CONTROLLED PLATE MILL

REFERENCE TO RELATED APPLICATION

This is a continuation-in-part of copending application Ser. No. 632,953, filed July 20, 1984, in the name of the same inventor and entitled PRESSURE CONTROLLED STRIP MILL, now abandoned.

TECHNICAL FIELD

The invention relates to means and a method of rolling flat workpieces, particularly workpieces of great width, utilizing a pair of small diameter work rolls, the chocks of which are slidably located in the mill housing to keep their axes in a single vertical plane, and more particularly to such a mill wherein both work rolls are supported by pressure transmission elements evenly spaced across their faces, the pressure transmission elements of at least one of the work rolls each being provided with a controllable fluid pressure means.

BACKGROUND ART

For purposes of an exemplary showing, the apparatus and method of the present invention will be described in terms of the rolling of metallic plate. It will be understood that the invention is equally applicable to the rolling of metallic sheets or strips. Furthermore, the workpiece need not necessarily be metallic since the principles of the present invention are applicable to the rolling of any appropriate plastically deformable strips, sheets or plates such as plastics or the like.

Mills for rolling steel and other plates or strips (particularly plates or strips of great width), employing small diameter work rolls to take heavier roll passes, have means provided to minimize deflection of the work rolls when subject to rolling pressure. If this were not the case, the workpiece would lose its flatness.

One way to minimize work roll deflection is to provide large diameter backing rolls. Another is to build the mill as a one-piece, rigid housing in the beams of which are located spaced backing elements to support the work rolls either directly, or through the intermediary or additional rolls. Mills of this type are disclosed, for example, in U.S. Pat. No. 4,295,355.

However, even very large diameter backing rolls will deflect somewhat under rolling load. To compensate for this, they are made barrel-shaped, so that the generant, which happens to be in the roll bite, will stay straight when under rolling pressure and thus preserve an even roll gap all the way across the workpiece (strip). Only when the roll gap is even, will the percentage of reduction in that roll pass be even across the width of the workpiece and, in turn, only in such a case will a flat workpiece stay flat after a roll pass of, for example, 15%.

In the one-piece housing type mills just mentioned, each one of the spaced backing elements is provided with eccentric adjustment means to preserve an even roll gap under rolling pressure. Such adjustment must be precise because even a 0.0001 inch difference in the roll gap will produce a visible wave after a wave-less strip is passed through such a mill.

Applicant has found that a uniform percentage of reduction of the thickness across the workpiece (which is a condition to produce an even elongation during the pass and, consequently, a flat workpiece), can be preserved even better by employing an apparatus and method wherein the rigidity of the backing elements is not relied upon to minimize work roll deflection, but wherein the evenness of the roll gap is assured by providing pressure transmitting elements evenly spaced across the face of the work roll. This approach has an advantage in also being able to control roll pressure across the workpiece so as to compensate for lack of flatness or uneven gauge or temper of the workpiece, and still produce a flat workpiece. If a workpiece is both flat and of even thickness, then all of the spaced pressure transmitting elements must be so adjusted that the roll pressure stays uniform all the way across the workpiece. Consequently, a pass reduction of, for example, 15% will also be uniform and the so-rolled workpiece will stay flat. This is all elementary, but since it represents a complete reversal of accepted practice of design of rolling mills for flat products, it is necessary to look where the adoption of this principle will lead in the design of the mill itself, and what it means to the process of rolling.

Assuming the rolling of steel or other material in plate or strip form, subjected to tension, on a multistand tandem mill, following a pass program, usually computer-made (according to the characteristics of the mill, its drive, the material and final gauge), such mill can be built with no screw down at all, and with no indication of the width of the roll gap. The thickness and flatness of the workpiece will be measured after each pass. This is a serious simplification of the equipment and of the control process. Nevertheless, as will be explained below with reference to the drawings, the mill itself (deprived of heavy backing elements), becomes simpler, lighter and less expensive.

DISCLOSURE OF THE INVENTION

According to the invention there is provided both mill apparatus and a method for rolling a workpiece (particularly a workpiece of great width), employing small diameter work rolls. The means and method are such that the accuracy and the flatness of the workpiece produced does not depend upon the rigidity of the mill.

The mill housing comprises two backing beams joined together at their ends by pairs of channels acting as mill columns and forming windows therebetween. Chocks for a pair of small diameter work rolls are slidably mounted in the windows.

Pressure transmitting elements are evenly spaced across the face of each work roll, the pressure transmitting elements for the upper work roll being operatively affixed to the upper backing beam and the pressure transmitting elements for the lower work roll being operatively connected to the lower backing beam.

The pressure transmitting elements for at least one of the upper and lower work rolls are each provided with a fluid pressure means, by which the pressure exerted by the pressure transmitting element can be instantly controlled (i.e. increased or decreased). The pressure transmitting elements of the other one of the upper and lower work rolls may each be similarly provided with fluid pressure means, but since it suffices to control the pressure of only one of the two work rolls, the pressure transmitting elements of the other work roll may be rigidly attached to its respective beam so that they all contact the work roll while the mill is empty.

The pressure transmitting elements of the present invention may take various forms. For example, they may each comprise a bracket supporting two rows of backing bearings. The rows of backing bearings are located to each side of the plane of symmetry in which the work roll axes are located. In another embodiment, each pressure transmitting element may comprise an endless chain of rollers contacting the work roll about part of its periphery and rolling against an arcuate anvil.

In a mill where smaller diameter work rolls are necessary, as in the rolling of wide plate or strip to light gauge, especially work-hardening materials, two intermediate rolls may be used to support each work roll, thereby constituting a well-known, six-high mill configuration. In this instance, each pressure transmitting element may comprise an endless chain of rollers contacting a portion of the periphery of each intermediate roll of its respective work roll and passing about an arcuate anvil.

Whether the mill is of a two-high or six-high configuration, the pressure-bearing capacity of the pressure elements of the type utilizing an endless chain of rollers can be significantly increased when each of the rollers of the chain comprises a number of short rollers mounted on the same shaft with the links between the roller shafts being very thin.

It is further within the scope of the invention to drive the roller chain such that the chain, itself, can serve as an auxiliary drive for its respective work roll so that its work roll may carry a lesser torque. This is important in mills for very wide plates where roll drive is critical. In instances where the roller chain itself is driven, the roller chain should be more of the nature of a traction chain, having heavier connecting links to sustain the pulling force.

In the practice of the present invention, the workpiece to be rolled is passed between the upper and lower work rolls and the pressure exerted on the work rolls by those pressure transmitting elements having fluid pressure means is constantly monitored and continuously increased or decreased across the face of one or both work rolls to compensate for lack of flatness, uneven gauge or temper of the workpiece. As a result, very wide plates or strips can be produced which are flat and of even thickness through the use of a mill which is far simpler in construction and lighter in weight than the conventional beam-backed mill. Furthermore, mills of the type described in the present application can be produced for handling plate or strip of greater widths (even several times greater) than hitherto possible.

Taking advantage of the small size of the pressure transmitting elements of the present invention, a mill can be provided with two spaced pairs of upper and lower work rolls, the work rolls of each pair being accurately and adjustably backed by pressure elements spaced along the length thereof in the manner taught herein. The two pairs of work rolls are driven at a fixed but controllable speed differential so as to maintain that portion of the workpiece between the pairs of work rolls under tension to achieve improved flatness of the workpiece and to permit heavier passes.

DETAILED DESCRIPTION OF THE INVENTION

Figure 2:
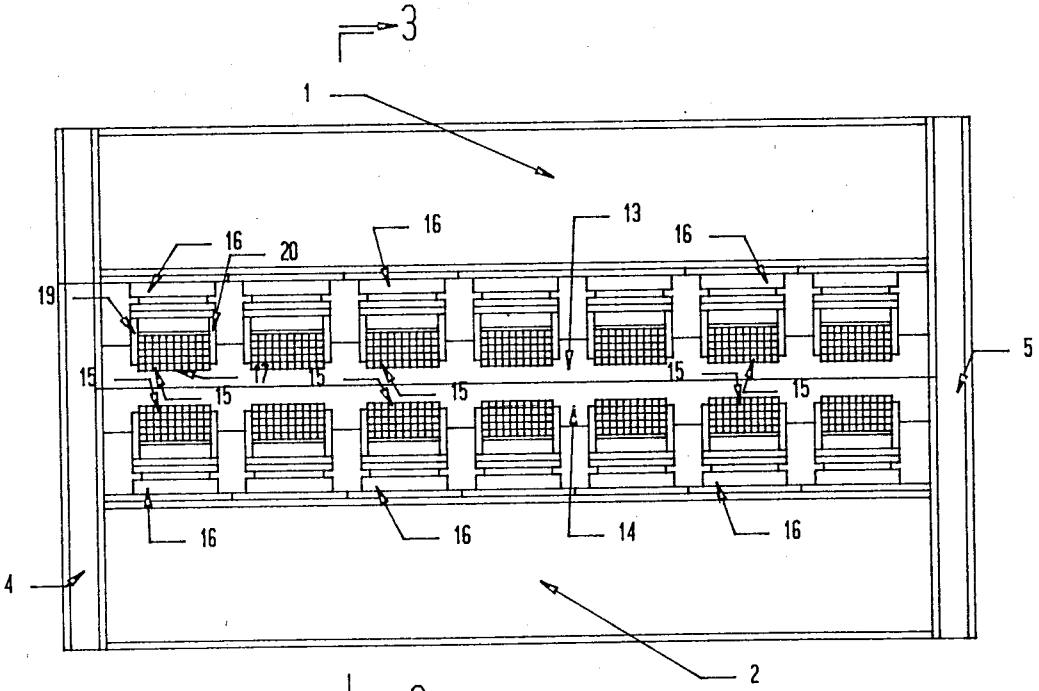
FIG. 2 is a front elevational view of the mill of FIG. 1.
Figure 3:
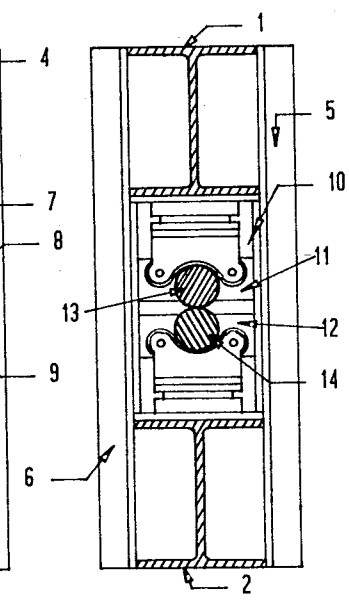
FIG. 3 is a cross sectional view taken along section line 3—3 of FIG. 2.
Figure 1:
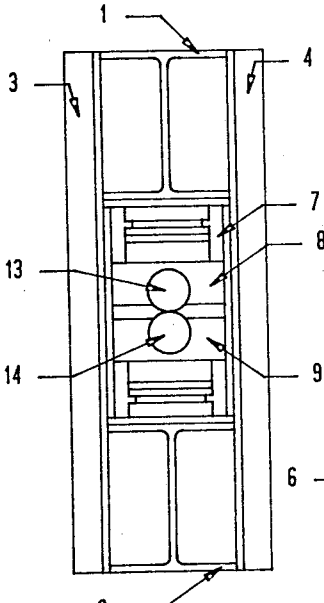
FIG. 1 is an end elevational view of an exemplary mill of the present invention.

Turning first to FIGS. 1 through 3 wherein like parts have been given like index numerals, the mill housing of the present invention comprises two backing beams 1 and 2, joined by four deep channels 3–6, acting as mill columns and disposed back-to-back at the ends of the beams 1 and 2. Channels 3 and 4 form between them a window 7 in which are mounted sliding chocks 8 and 9. Similarly, channels 5 and 6 form between them a window 10 in which chocks 11 and 12 are slidably mounted. Upper work roll 13 is mounted in chocks 8 and 11 and lower work roll 14 is mounted in chocks 9 and 12, allowing vertical displacement of work rolls 13 and 14 in a common vertical plane of symmetry. Each work roll 13 and 14 has a splined end (not shown) adapted to accept drive from a spindle (not shown), as is well known in the art. For purposes of an exemplary showing, the mill housing in FIGS. 1, 2 and 3 is proportioned for a workpiece 80 inches wide, and weighs only about 20% of the weight of a conventional housing of, for example, a four-high mill built for a workpiece of the same width. The reason for this lies in the fact that, while the mill housing must be amplying strong to withstand the heavy roll separating force, it may flex under such loads, since the accuracy of the workpiece produced does not depend upon its rigidity. For instance, in a beam-backed mill of this size, such as described in U.S. Pat. No. 2,479,974 in the name of applicant, a beam deflection at the center of the workpiece should not exceed 0.001 inch, whereas in the mill housing according to the present invention, a deflection of the beam under rolling pressure may be tolerated even up to 0.020–0.040 inch.

The essence of the present invention lies in the means and method of backing the slender work rolls 13 and 14. At least one of the upper work roll 13 and the lower work roll 14 (and for purposes of explanation let us say the upper work roll 13) is provided with spaced pressure transmitting elements along its length to absorb the roll separating force and thus prevent deflection of the work roll. Fluid pressure means, such as hydraulic cylinders 16, are provided for each of the pressure transmitting elements of the upper work roll 13, with means to instantly control their pressure, as required by the rolling process. The lower work roll 14 may have similar pressure transmitting elements with fluid pressure means provided symmetrically along its length, or it may have pressure transmitting elements (without fluid pressure means) located symmetrically along its length, and affixed directly to the adjacent surface of backing beam 2 and serving simply as backing bearings. Following the principle of the present invention, such simplification is permissible because the lower work roll 14 will deflect under roll pressure to the extent that the adjacent backing beam 2 will deflect, but the resulting displacement of each pressure transmitting element for lower work roll 14 will be automatically compensated by the opposite or corresponding fluid pressure-controlled element 12 of the upper work roll 13.

It will be understood that the pressure transmitting elements for upper work roll 13 may all be identical and may be identical to the pressure transmitting elements for lower work roll 14. The pressure transmitting elements of both the upper work roll 13 and lower work roll 14 may each be provided with fluid pressure means. On the other hand, the pressure transmitting elements of lower work roll 14 may be provided with fluid pressure means and the pressure transmitting elements for upper work roll 13 may not, being affixed directly to the adjacent surface of backing beam 1 and serving simply as backing bearings.

In FIGS. 1, 2 and 3, work roll 13 is shown supported by seven pressure transmitting elements generally indicated at 15, each provided with a fluid pressure means in the form of a hydraulic cylinder 16. The pressure transmitting elements 15 are evenly spaced along the length of upper work roll 13. In the embodiment shown, lower work roll 14 is provided with identical pressure transmitting elements 15, each located directly beneath the corresponding pressure transmitting element of upper work roll 13 and each provided with a hydraulic cylinder 16. FIG. 2 could also be considered to illustrate an instance wherein either the upper work roll 13 or the lower work roll 14 is provided with pressure transmitting elements 15 which do not have fluid pressure means. In such an instance, the members 16 for that row of pressure transmitting elements not provided with fluid pressure means may simply be considered to represent mounting means by which each such pressure transmitting element is affixed to the adjacent surface of the adjacent backing beam 1 or 2. In the embodiment of FIGS. 1 and 2, fluid pressure may be dropped to zero in cylinders 16 of the lower row. The pistons of these cylinders will drop to the bottom of their stroke and will evenly back lower work roll 14 as though they were simple backing bearings, while pressure transmitting elements 15 of the upper work roll 13 will suffice to control its rolling pressure at all points across its face which permits rolling according to the subject method.

The purpose of each pressure transmitting element 15 is to transmit a controllable force upon a certain sector of rotating work roll 13 or 14. Therefore, each pressure transmitting element 15 must constitute a kind of bearing, engaging a part of the circumference of work roll 13 or 14 and generating very little friction. Depending upon the rolling program of the mill, one of several types of pressure transmitting elements can be chosen.

Figure 4:
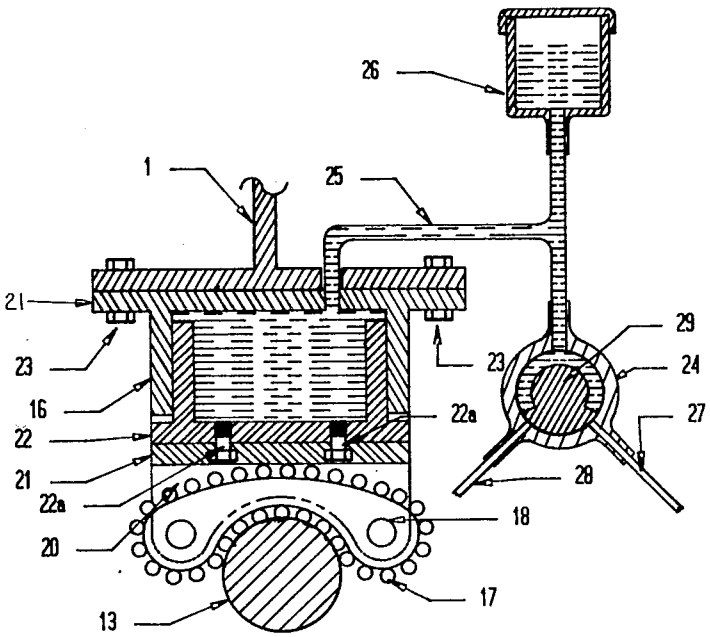
FIG. 4 is a fragmentary view, partly in cross section, of a pressure transmitting element of FIGS. 2 and 3.

An embodiment of pressure transmitting element 15 is shown in greater detail in FIG. 4. The pressure transmitting element 15 comprises an endless chain of rollers 17 contacting work roll 13 around part of its periphery and rolling against an arcuate anvil 18. Two side plates 19 and 20 are attached to anvil 18, one on each side, and are additionally welded to a horizontal plate 21. The horizontal plate 21 is affixed to the piston 22 of cylinder 16, by any suitable means such as bolts **22*a*. Plates 19 and 20 are sized to provide clearance for the chain of rollers 17 for their return pass. Cylinder 23 is affixed to the bottom of backing beam 1 by any suitable means such as bolts 23**.

FIG. 4 also shows one method of controlling the fluid pressure in cylinder 16. A valve 24 is connected to cylinder 16 by pipe 25 which also is connected to an accumulator 26. Valve 24 has a supply pipe 27 connected to a source (not shown) of high pressure fluid, and another conduit 28 leading to tank (for closed circuit operation). Rotary slide 29 normally keeps both connections 27 and 28 closed, accumulator 26 giving this rigid system the necessary elasticity.

When it is intended to increase pressure in the cylinder 16, rotary slide 29 is caused to make one quick oscillation back and forth, opening the high pressure line 27 for a short fixed period of time, say 20 microseconds. This adds to the volume of fluid in the cylinder system, a fixed minute volume of fluid, thereby compressing the gas in the accumulator 26 and increasing the pressure. Usually several such increases are needed and they follow in rapid succession. The opposite happens when pressure must be reduced, rotary slide being oscillated to open conduit 28 for a short fixed period of time. This also usually occurs in several rapid oscillations in succession. Other systems of pressure control can also be used. The above described system of fixed minute steps combines simplicity and precision. Whatever the nature of the pressure control system for each cylinder 16 might be, the pressure control system can be manually actuated, or it can be responsive to an appropriate sensor.

Figure 5:
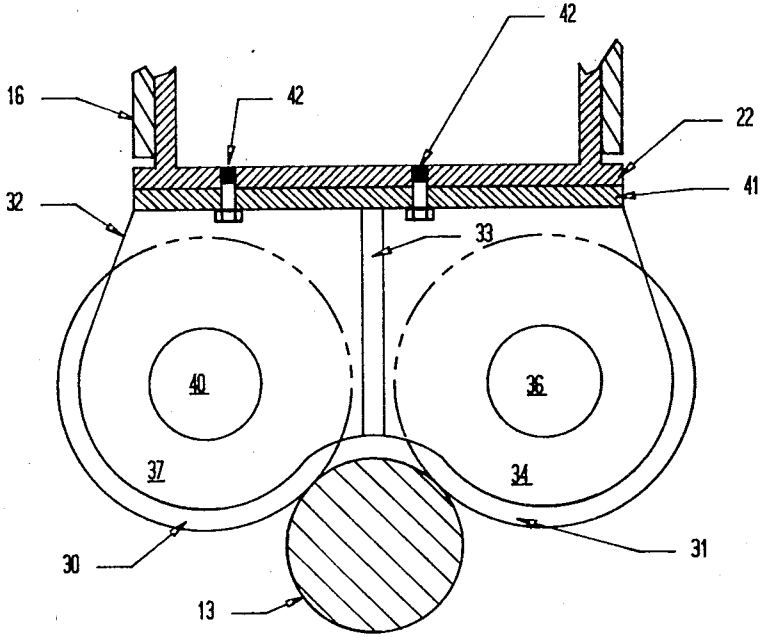
FIG. 5 is an end view, partly in cross section, of another embodiment of the pressure transmitting element of the present invention.
Figure 6:
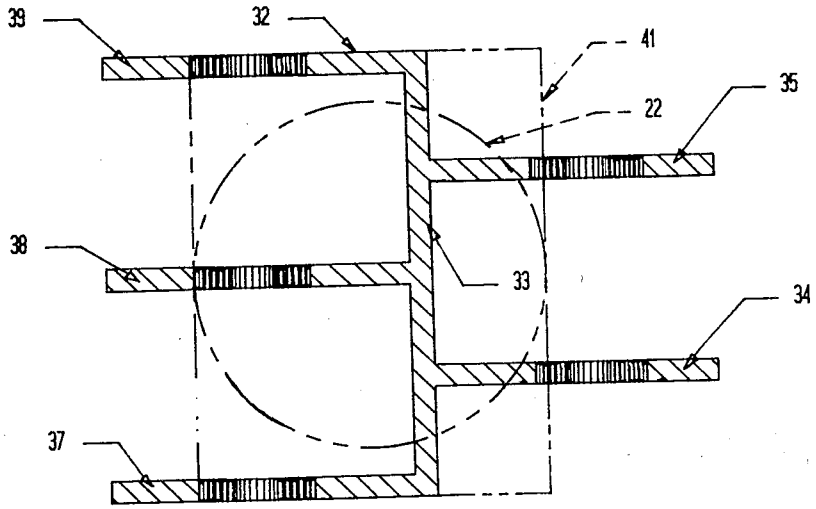
FIG. 6 is a plan view, partly in cross section, of the frame of FIG. 5.

Another embodiment of pressure transmitting element is illustrated in FIGS. 5 and 6. In this embodiment, the work roll 13 is shown backed by two rows of backing bearings 30 and 31, which are, in this exemplary embodiment, arranged in groups of three—two backing bearings 30 on one side of work roll 13 and one backing bearing 31 on the other side side thereof. The backing bearings 30 and 31 are held in a bracket, generally indicated at 32. Bracket 32 is illustrated without backing bearings 30 and 31 in FIG. 6, for clarity's sake.

Bracket 32 comprises a vertically oriented plate 33 extending in a direction parallel to the axis of upper work roll 13. Affixed to one face of plate 33, perpendicular thereto, is a pair of brackets 34 and 35 in parallel spaced relationship. The single backing bearing 31 is located between brackets 34 and 35 and is rotatively mounted thereto by shaft 36. In similar fashion, three brackets 37, 38 and 39 are affixed to the opposite face of plate 33 and extend normal thereto in parallel spaced relationship. The pair of backing bearings (one of which is shown at 30 in FIG. 5) are rotatively mounted to and between the brackets 37, 38 and 39 by shaft 40 (see FIG. 5).

The bracket 32 also includes a horizontal top plate 41 shown in FIG. 5 and illustrated in broken lines in FIG. 6. Top plate 41 is adapted to be affixed to the piston 22 of cylinder 16 in any suitable manner, as by bolts 42, so that the pressure transmitting element of FIGS. 5 and 6 can transmit the controllable force of cylinder 16 on the adjacent sector of upper work roll 13. It will be apparent from FIGS. 5 and 6 that cylinder 16 and bracket 32 are situated off-center with respect to the axis of upper work roll 13. The axis of cylinder 16 intersects a horizontal line extending between and perpendicular to the axes of shafts 36 and 40 at one third the distance therebetween. Thus the two backing bearings (one of which is shown at 30) mounted on shaft 40 exert an equal but opposite moment with reference to said axis of cylinder 16 as does the single backing bearing 31 mounted on shaft 36. Only vertical components are considered since the horizontal components are absorbed within the common bracket 32 of FIGS. 5 and 6.

Figure 7:
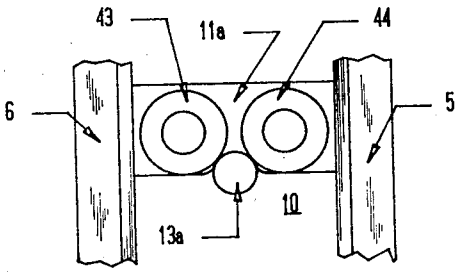
FIG. 7 is a fragmentary end view of a mill, similar to FIG. 1, and provided with intermediate rolls.
Figure 8:
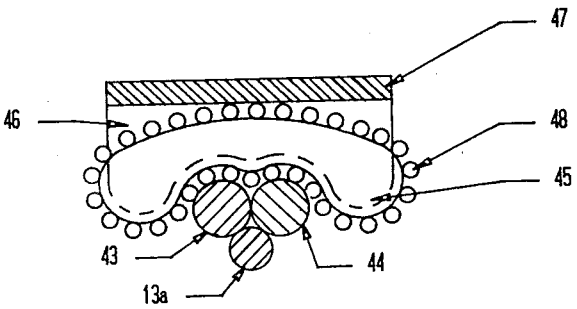
FIG. 8 is a cross sectional view of a pressure transmitting element for the mill of FIG. 7.

When pressure transmitting elements of the type described with respect to FIGS. 5 and 6 are employed, the pressure transmitting elements are alternated: Where one element has the two backing bearings 30 on one side of work roll 13, its neighbor will have the single backing bearing 31 on that same side, and so on. This is necessary, first of all, to minimize possible marking of work roll 13 where a gap between two bearings on one side faces a bearing on the other. Secondly, this is necessary in order to have one pressure transmitting element always support the same short length of work roll 13 as the other elements.

Where smaller diameter work rolls are necessary, as for rolling wide plate strip to light gauges, especially when the workpiece comprises work hardening metals such as high-carbon or stainless steels, two intermediate rolls may be used to support each work roll, making a well-known six-high mill. FIGS. 7 and 8 show such a mill, built according to the present invention.

FIG. 7 is a fragmentary view similar to FIG. 1, illustrating the channels 5 and 6, the window 10 defined thereby, an upper chock 11*a* and an upper work roll 13*a*. The upper chock 11*a* is similar to upper chock 11 of FIG. 3, but provides bearings for a pair of intermediate rolls 43 and 44. The upper work roll 13*a* is free floating and is guided in the vertical plane of symmetry of the mill by intermediate rolls 43 and 44. It will be understood that the lower work roll (not shown) will similarly be supported and guided by a pair of chock mounted intermediate rolls (not shown).

FIG. 8 illustrates an exemplary pressure transmitting element for use with a mill of the type described with respect to FIG. 7. The pressure transmitting element of FIG. 8 is similar to that of FIG. 4 and comprises an arcuate anvil 45, similar to anvil 18 of FIG. 4. The anvil is rigidly held between a pair of plates, one of which is shown at 46. These plates are similar to plates 19 and 20 of FIG. 2. The pair of plates (one of which is shown at 46) is mounted to a horizontal plate 47 equivalent to horizontal plate 21 of FIG. 4. The plate 47 is adapted to be affixed to the piston 22 of cylinder 16, in the same manner described with respect to FIG. 4. The anvil 45 supports a continuous chain of rollers 48 and the structure is so configured as to insure clearance for the return passage of endless chain of rollers 48.

Anvil 45 is so shaped that the endless chain of rollers 48 contacts intermediate rolls 43 and 44 around parts of their peripheries. The anvil 45 and continuous chain of rollers 48 serve essentially the same purpose as anvil 18 and rolls 17 of FIG. 4, except that they operate on intermediate rolls 43 and 44. The anvil 45 also acts as a beam to absorb the horizontal components of the roll pressure exerted by the intermediate rolls 43 and 44.

While FIGS. 4, 5, 6 and 8 illustrate pressure transmitting elements applied to upper work roll 13 or upper work roll 13*a*, it will be understood that identical pressure transmitting elements may also be applied to the corresponding lower work rolls, as shown in FIG. 2. Both sets of pressure transmitting elements may be affixed to the pistons of cylinders 16. Since, as set forth hereinabove, the rolling method of the present invention can rely upon accurate control of pressure of only one work roll (preferably the upper work roll) by spaced pressure transmitting elements, the set of pressure transmitting elements of the opposite (the lower) work roll may be rigidly affixed to the corresponding housing beam.

During operation of the mill of the present invention, if work roll pressure is to be kept uniform all the way across the workpiece, as when rolling plate or strip of maximum width for the mill, fluid pressure in all of the cylinders 16 should be kept the same. When rolling a workpiece of narrower width, on the other hand, pressure should be the same only in the cylinders 16 of those pressure transmitting elements supporting work roll sectors situated within the width of the workpiece. The cylinders 16 of those pressure transmitting elements supporting work roll sectors only partly within the width of the workpiece (i.e. at the workpiece edges) should be maintained at an intermediate pressure value. Those cylinders 16 of pressure transmitting elements supporting work roll sectors wholly outside the workpiece width should be maintained at zero pressure.

The structure of the present invention results in a compact, strong and relatively light mill housing which is particularly valuable in mills for rolling very wide plates or strips (for example, plates or strips greater than about 80 inches wide). In fact, mills according to the present invention can be built for strips where conventional four-high mills become too large to be considered and where even the known beam-backed mills (e.g., according to the above noted U.S. Pat. No. 2,479,974) require housings weighing several hundred tons. On the other hand, a mill for 200 inch wide stainless steel strip rolled down to 1/6th inch thickness, built according to FIG. 2, would weigh (complete including drive spindles, etc.) barely 125 tons.

The widest mill for steel that is in operation today, is a beam-backed mill in West Germany, rolling strip up to 109 inches wide. This mill weighs over 350 tons, so it would be out of the question to design such a mill for 200 inch wide strip. On the contrary, for mills according to the present invention, a 200 inch width is far from being the limit. Should a need arise for 400 inch wide strip, such a mill can be easily built in accordance with the present invention and would not be overly heavy.

The teachings of the present invention are also applicable to mills intended to roll workpiece strip, sheets or plates of narrower widths (80 inches or less). Such mills, if built in accordance with the present invention, would be lighter weight, simpler in construction and less expensive.

Reference is made to FIGS. 9 through 12 wherein a preferred embodiment of the pressure transmitting element of FIG. 4 is illustrated. The pressure transmitting element of FIGS. 9 through 12 has a pressure-bearing capacity considerably surpassing that of the pressure transmitting element described with respect to FIGS. 5 and 6. The pressure transmitting element of FIGS. 9 through 12 may have many applications, in part due to its relatively small space requirements, and may be used in other rolling mills and used to create new mill types not possible without the use of such a pressure transmitting element.

Figure 10:
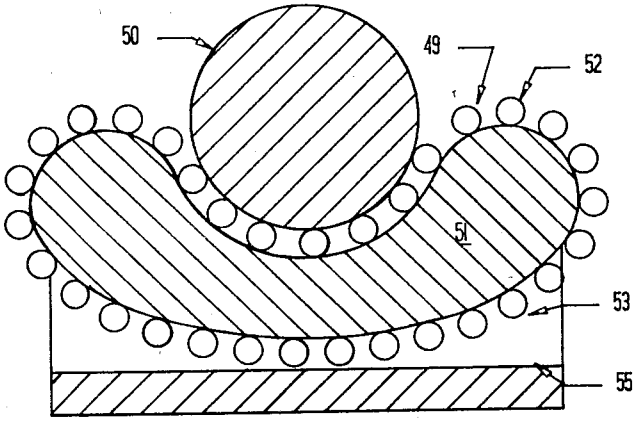
FIG. 10 is a cross sectional view taken along section line 10—10 of FIG. 9.
Figure 9:
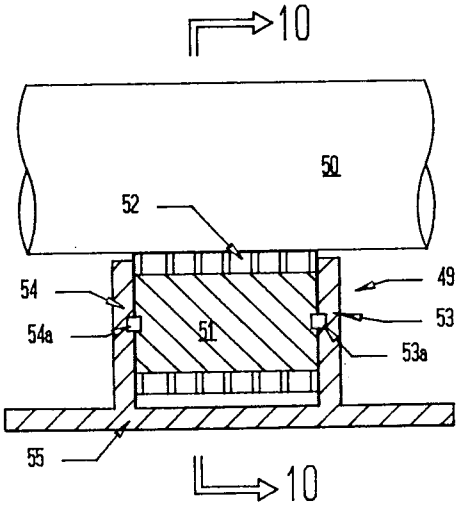
FIG. 9 is a fragmentary cross sectional view of another embodiment of the pressure transmitting element of the present invention.

Referring more specifically to FIGS. 9 and 10, the pressure transmitting element is generally indicated at 49 and, for purposes of an exemplary showing, is illustrated in association with a lower work roll 50. It will be understood that pressure transmitting element 49 can be used with an upper work roll, without change. Pressure transmitting element 49 comprises an arcuate anvil 51 similar to anvil 18 of FIG. 4. The arcuate configuration of anvil 51 forms a cavity or depression in the upper surface thereof to receive the load. The anvil 51 is surrounded by an endless chain of rollers 52, which transmits the pressure exerted by work roll 50 to the anvil 51.

A pair of side plates 53 and 54 are keyed as at 53*a* and 54*a* to the anvil 51. Side plates 53 and 54 are similar to side plate 20 of FIG. 4, and are so sized as to provide clearance for the chain of rollers 52, for its return flight. Side plates 53 and 54 are welded or otherwise appropriately affixed to horizontal plate 55, equivalent to horizontal plate 21 in FIG. 4. The horizontal plate 55, in turn, may be bolted to a piston, as in the case of the structure of FIG. 4, or directly to the adjacent surface of a backing beam of the rolling mill.

Figure 11:
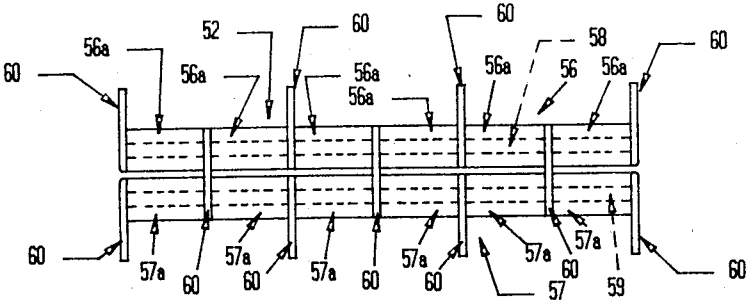
FIG. 11 is a fragmentary plan view of the roller chain of FIGS. 9 and 10.

As is most clearly shown in FIG. 11, the primary difference between the pressure transmitting element 49 of FIGS. 9 and 10, and that of FIG. 4, lies in the make up of the roller chain 52, itself. FIG. 11 shows a short length of two neighboring rollers, generally indicated at 56 and 57. Each roller comprises a number of short roller segments 56*a* and 57*a*. While the number of roller segments is not limiting, for purposes of an exemplary showing, the rollers 56 and 57 are illustrated as being made up of six such segments. The segments of each roller 56 and 57 are mounted on a single pin or shaft 58 and 59. Hardened and ground steel rollers, whether they are for roller bearings, roller chains or frictionless glideways, usually have a diameter to length ratio of 1/1 to 1/2. This is dictated by manufacturing considerations such as warpage, heat treating and centerless grinding. The rollers should have a diameter such that they will extend beyond the profile of the links 60 connecting shafts 58 and 59.

Since the roller chain 52 transmits no tension, the links 60 therebetween can be very thin (say 0.020" spring steel links for ¾" diameter rollers) the thinness of the links 60 gives a two-fold advantage. First of all, very little axial space is lost. Secondly, elastic depression caused in the work roll by the roller is practically constant over the face of the entire roller, so that regular tapers at the ends of all of the roller segments to prevent stress concentration are not necessary.

Figure 13:
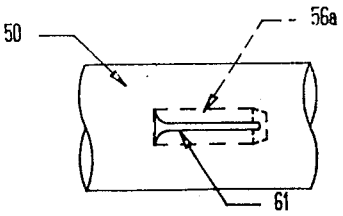
FIG. 13 is a semi-diagrammatic plan view of a work roll and a single roller of a chain of rollers demonstrating the impression made on the work roll by the roller with one of its ends tapered and the other end not.
Figure 12:
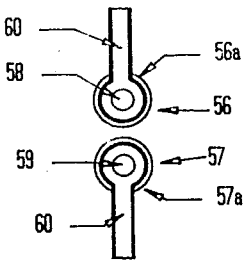
FIG. 12 is an end view of the roller chain of FIG. 11.

The value of the last mentioned advantage can be explained as follows. The rollers of the chain 52 transmit pressure (roll separation force) from work roll 50 to anvil 51 along two opposed generants. This causes an elastic deflection of all three elements. As a result, there will be a narrow area of contact (rather than line contact) between a given one of the rollers of roller chain 52 and work roll 50. If each roller of roller chain 52 and work roll 50 constituted cylindrical bodies of continuous, indeterminate length, the width of the area of contact therebetween would be uniform so long as the roll separation force is uniform across the roll face, as in rolling flat articles. However, conditions are different at the vicinity of the end of a roller of roller chain 52, since the elastic depression caused by it in work roll 50 cannot stop abruptly, but follows elastic stress flow lines. This is illustrated in greatly exaggerated form in FIG. 13. FIG. 13 illustrates at 61 the elastic depression caused in the surface of work roll 50 by a single segment 56*a* of roller 56, if it were operating on work roll 50 all by itself. The roller segment 56*a* is shown in broken lines, since it would otherwise obscure the elastic depression 61. As viewed in FIG. 13, the left hand end of roller segment 56*a* is strictly cylindrical. Throughout most of the length of roller segment 56*a*, the elastic depression 61 is of narrow, uniform width. However, at the left hand end of roller 56*a*, it will be noted that the elastic depression widens like a funnel.

The remedy for this situation is well known in the art and consists of providing a taper at the end of roller segment 56*a*. For purposes of this demonstration, the right hand end of roller segment 56*a* is shown provided with a taper. For clarity, the taper is exaggerated in FIG. 13. As is shown in FIG. 13, the effect of this taper is to reduce the pressure to zero at the end of roller segment 56*a* and the elastic depression in the work roll 50 narrows down to zero width. However, tapering both ends of each roller segment 56*a* would involve a loss in the load-carrying capacity of roller 56, since both ends of each roller segment 56*a* would carry diminishing loads.

Figure 14:
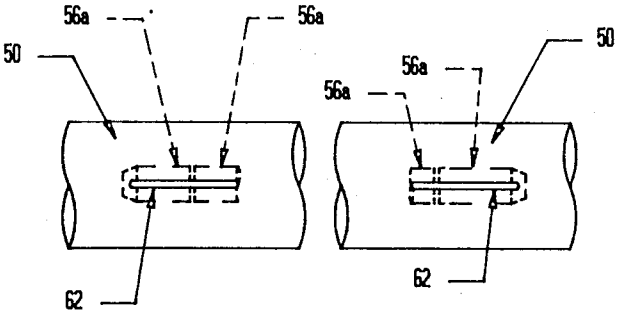
FIG. 14 is a semi-diagrammatic plan view of a work roll and a segmented roller of the present invention illustrating the impression made by the segmented roller upon the work roll.

FIG. 14 is similar to FIG. 13, diagrammatically and fragmentarily illustrating the work roll 50 and the impression made thereon by the entire chain roller 56 of FIG. 11. Since the roller segments 56*a* have an end-to-end gap of only about 0.020 inches (by virtue of the spring steel links 60—not shown), only the outermost ends of the outermost roller segments 56*a* need be tapered, as shown in FIG. 14. Since the remaining ends of all of the segments 56*a* are nearly abutting, no relief of them is required, the stress flow lines bridging the narrow gaps therebetween without perceptible stress concentration. Thus, the elastic depression 62 made upon work roll 50 is of substantially uniform width throughout its length. Depending upon the number of segments per roller, of roller chain 52, it may be possible in some arrangements to eliminate selected ones of thin spring steel links, under which circumstances adjacent ends of selected roller segments can actually be in abutting relationship.

The construction of the roller chain of FIG. 11, wherein the rollers are made up of roller segments, enables the roller segments to be more easily, accurately and inexpensively manufactured. Each of the rollers of the chain 52 will carry a full load throughout its length, except for the very endmost portions of the endmost roller segments of each roller.

Figure 15:
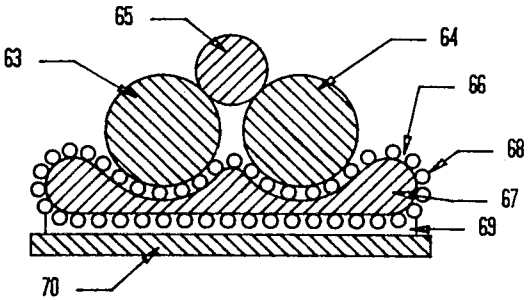
FIG. 15 is a semi-diagrammatic representation of the chain of rollers of FIGS. 9–12 as applied to a six-high mill.

The roller chain of FIG. 11 can be readily employed in pressure transmitting elements for use with a six-high mill of the type generally described in connection with FIG. 7. This is illustrated in FIG. 15, wherein a pressure transmitting element for backing rolls 63 and 64 of a lower work roll 65 is shown. It will be understood that a pressure transmitting element for the backing rolls of an upper work roll will be substantially identical.

The pressure transmitting element of FIG. 15 is generally indicated at 66 and is in many respects similar to the pressure transmitting element 49 of FIGS. 9 and 10. The pressure transmitting element 66 comprises an anvil 67 having two depressions formed therein for transmission of roll separating forces from backup rollers 63 and 64 to the anvil 67. The anvil is surrounded by a roller chain 68 which is substantially identical to roller chain 52 of FIG. 11. The anvil 67 is keyed to and between a pair of side plates, one of which is shown at 69. The side plates, in turn, are welded or otherwise appropriately affixed to a horizontal plate 70. The horizontal plate 70 may be bolted or otherwise appropriately affixed to the piston of a hydraulic cylinder, or directly to the backing beam (not shown) of the mill. It will be noted that the arrangement of FIG. 15 is substantially the same as that of FIG. 8, utilizing the roller chain of FIG. 11. The arrangements of FIGS. 8 and 15 are particularly advantageous for a mill rolling plates of very wide width, where the work rolls would not have enough torque-transmitting capacity.

The width of the pressure transmitting elements of FIGS. 9 and 15, measured axially of the work roller, is limited primarily by the optimum practical width of the roller chain. Each pressure transmitting element backs its respective work roll over a certain portion of its face. Therefore, for complete backing of the work roll, a sufficient number of such pressure transmitting elements must be provided to cover the whole face of the work roll, the pressure transmitting elements being arranged in side-by-side orientation.

Figure 16:
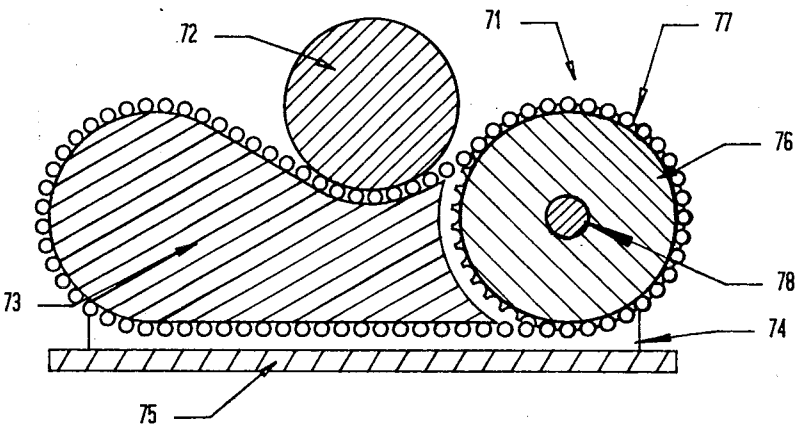
FIG. 16 is a cross sectional, elevational view, similar to FIG. 10, and illustrating a pressure transmitting element having a driven, traction-applying roller chain.

In some rolling mills for rolling flat work pieces, pressure transmitting elements of either FIG. 9 or 15 could be designed to perform an additional function, that is to help the work roll transmit the necessary torque. This is particularly true in cases where the pressure-bearing capacity of the pressure transmitting elements is less critical, and the transmission of torque is quite critical, as in mills for rolling wide plates. In such an instance, with the chain being designed so that it can transmit traction to the work roll, it would be expedient to drive the roller chain and use it as an auxiliary drive, to assist the work roll. For purposes of an exemplary showing, FIG. 16 illustrates a pressure transmitting element, similar to that of FIGS. 9 and 10, but having a driven, traction-transmitting roller chain. Such a chain would be similar to that illustrated in FIG. 11, but would have heavier connecting links and would be capable of substantial pulling force. FIG. 16 illustrates a pressure transmitting element, generally indicated at 71, for a lower work roll 72. It will be understood that such a pressure transmitting element for an upper work roll would be substantially identical.

The pressure transmitting element 71 is similar to pressure transmitting element 49 of FIG. 9, having an arcuate anvil 73 with a depression to receive the load. The anvil 73 is keyed to a pair of side plates (one of which is partially shown at 74), similar to side plates 53 and 54 of FIG. 9. The side plates are welded or otherwise appropriately affixed to a horizontal plate 75. The plate 75 may be attached directly to a backing beam of the mill, or it may be attached to a hydraulic cylinder of the type shown in FIG. 4.

The pressure transmitting element 71 of FIG. 16 differs from the pressure transmitting element 49 of FIG. 9 in that one of the end lobes of anvil 73 has been replaced by a sprocket 76 which engages and drives the roller chain 77, which surrounds the anvil 73 and sprocket 76. The lobe portion of anvil 73 which is replaced by sprocket 76 is out of the load carrying zone of the anvil. Thus, the sprocket 76 is also out of the load carrying zone. While some load carrying capacity is sacrificed in the pressure transmitting element 71, as compared to the pressure transmitting element 49 of FIGS. 9 and 10, the roller chain 77 is capable of transmitting a substantial traction to work roll 1, helping to drive the work roll and causing the work roll to carry less torque. This feature is important in mills for very wide plates, where roll drive is critical. Sprocket 76 is non-rotatively affixed to a shaft 78 which passes through appropriate bearings (not shown) in the side plates of the pressure transmitting element 71. The shaft 78 extends the length of the work roll and in similar fashion drives sprockets for the other pressure transmitting elements of work roll 72. The end of shaft 78 is attached to an appropriate drive means (not shown).

Tolerable flatness is not obtainable on prior art beam-backed plate mills, even those with spaced adjustable roll supports and even when using very small passes. After rolling, the plates must be annealed and then repeatedly passed through a roller leveler and/or hydraulically stretched. The teachings of the present invention enable the provision of plate mills capable of producing plate having excellent flatness characteristics without additional steps. To obtain unprecedented flatness in a very few passes, advantage may be taken of the small size of the pressure transmitting elements of the present invention, enabling the provision of a mill similar to that of FIGS. 1 through 3, but provided with two parallel, spaced pairs of upper and lower work rolls. Such a mill is illustrated in simplified fashion in FIG. 17.

Figure 17:
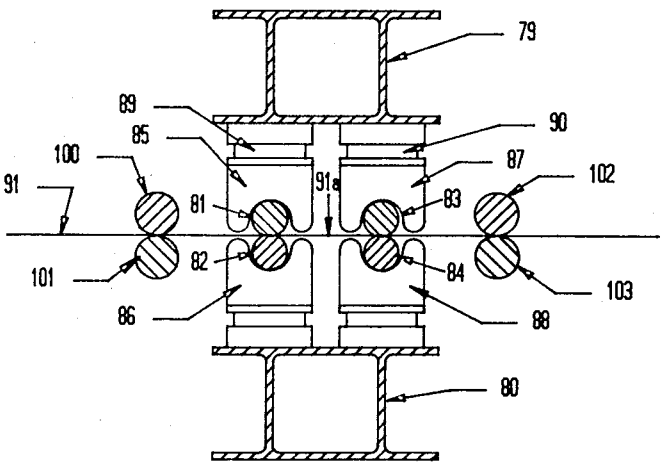
FIG. 17 is a simplified cross sectional view of a mill having two pairs of work rolls provided with pressure transmitting elements of the present invention.

As in the case of the mill of FIGS. 1 through 3, the mill of FIG. 17 is provided with upper and lower backing beams 79 and 80. It will be noted that the backing beams 79 and 80 are of double construction. The mill of FIG. 17 is provided with a first pair of upper and lower work rolls 81 and 82 and a second pair of upper and lower work rolls 83 and 84. In FIG. 17 the mill columns and the sliding chocks for work rolls 81 through 84 have been eliminated, for purposes of clarity. Each of the work rolls 81 through 84 is provided with a plurality of pressure transmitting elements spaced across its face, in substantially the same manner shown in FIG. 2. One such pressure transmitting element for each of the rolls 81 through 84 is shown at 85 through 88, respectively. Any of the pressure transmitting elements of the present invention can be used. For purposes of an exemplary showing, the pressure transmitting elements 85 through 88 may be considered to be the preferred embodiment illustrated in FIGS. 9 and 10. The pressure transmitting elements, represented by elements 86 and 88 for lower work rolls 82 and 84 are shown attached directly to lower backing beam 80. The upper pressure transmitting elements, represented by elements 85 and 87 for the upper work rolls 81 and 83, are attached to the upper backing beam 79 through the intermediary of controllable pressure instrumentalities 89 and 90, preferably in the form of hydraulic cylinders, as described with respect to FIGS. 2 and 4. As indicated above with respect to FIG. 2, it is within the scope of the present invention to attach the pressure transmitting elements represented by elements 85 and 87 for the upper work rolls 81 and 83 directly to the backing beam 79 and to provide the pressure transmitting elements represented by elements 86 and 88 for the lower work rolls 82 and 84 with controllable pressure instrumentalities such as hydraulic cylinders. Similarly, both the pressure transmitting elements for the upper work rolls 81 and 83 and for the lower work rolls 82 and 84 could be provided with hydraulic cylinders.

The essence of the mill of FIG. 17 lies in the feature that the two pairs of work rolls 81–82 and 83–84 have rigidly correlated drives such that the portion 91*a* of workpiece 90 which extends between the pairs of work rolls is maintained under tension. This results in two advantages: first, it improves the flatness of workpiece 91. Secondly, it permits heavier passes. For example, a nickel-based alloy plate 100×200×0.2 inches can be rolled from a thickness of 0.35 inches in five to seven passes. The operation of the mill of FIG. 17 hinges upon an accurate control of the surface velocities of the two pairs of work rolls 81–82 and 83–84, preferably capable of rolling in both directions, to increase production.

Figure 18:
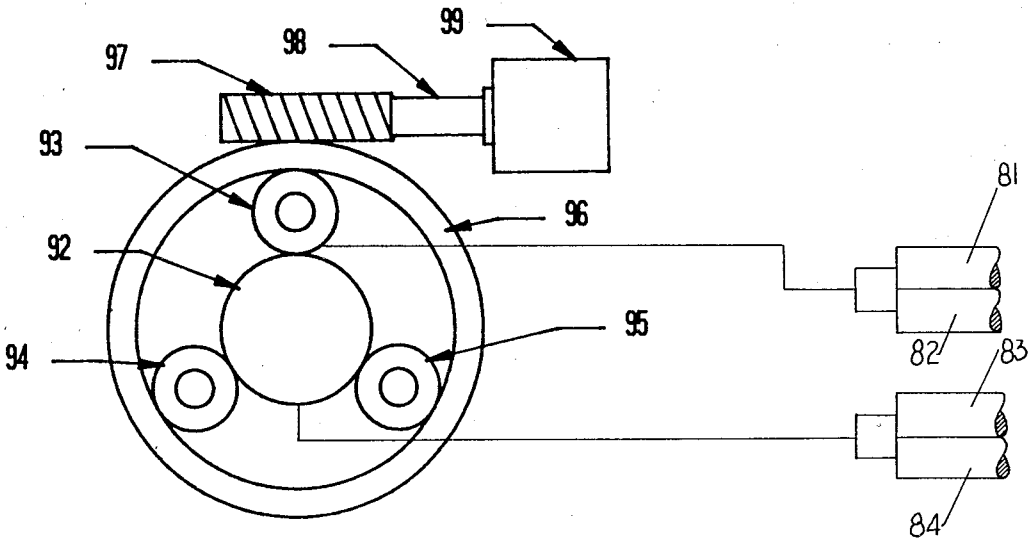
FIG. 18 is a semi-diagrammatic representation of an exemplary drive gear arrangement for the mill of FIG. 17.

Such accurate control can be achieved, for instance, by using a gear arrangement of the type semi-diagrammatically illustrated in FIG. 18. In FIG. 18, the sun gear 92 is surrounded by and meshes with satellite gears 93, 94 and 95. The satellite gears are joined together by appropriate spider means (not shown). The satellite gears 93, 94 and 95 are surrounded by and mesh with internally toothed ring gear 96. Ring gear 96 is also externally toothed and meshes with worm 97 mounted on the shaft 98 of a gear motor 99.

When the ring gear 96 is stationary, there is a fixed ratio between the angular velocities of the sun gear 92 and satellite gears 93, 94 and 95. By rotating worm 97 through the agency of gear motor 99, and thus ring gear 96, at controlled velocities (clockwise or counter-clockwise) the ratio between the angular velocities of sun gear 92 and satellite gears 93, 94 and 95 can be precisely changed or adjusted, by a small percentage, and that adjusted ratio will stay fixed so long as the ring gear 96 is rotated at the same speed by work 97. As a consequence, for a given angular velocity of sun gear 92, the velocity of the spider joining satellite gears 93, 94 and 95 can be accurately and rigidly controlled.

Assuming that the sun gear 92 has a shaft used to drive work roll pair 81–82 and that the spider assembly (not shown) supporting satellite gears 93, 94 and 95 has a shaft used to drive work roll pair 83–84, the ratio of the surface velocities of work roll pair 81–82 and work roll pair 83–84 can be accurately controlled through the agency of worm 97 which, in turn, will control the tension of that portion 91*a* of workpiece 91 between the work roll pairs 81–82 and 83–84. When the mill is a reversing mill, upon reversal the rotation of worm 97 is also reversed, having the same velocity but opposite direction. In this way the same tension between the two pairs of work rolls will be achieved, on condition, of course, that the work roll pairs are set for the same pass reductions.

The mill of FIG. 17 may be provided with pairs of pinch rolls 100–101 and 102–103 located on either side of the mill for the purpose of clamping the first or last portions of the workpiece and feeding it back into the roll bite. With the aid of these pinch rolls, rolling of each plate can be programmed entirely automatically.

As explained above, the mill of FIG. 17 is capable of rolling plates of unprecedented flatness and in a very few passes. Besides the feature of control of the roll pressure all the way across the roll face (which enables the obtaining of uniform plate elongation), the portion of the plate located between the two work roll pairs, when the work roll pairs are driven with the required ratio of their respective surface velocities, is under tension enabling the obtaining of heavier reductions per pass and stretching the workpiece to preserve its flatness.

In operation, roll pressure controlled by the hydraulic pressure in cylinders 89 and 90 is set evenly across the width of the workpiece, except those cylinders near the edge of the workpiece which are set at a considerably diminished pressure. Any variations in percent pass reduction across the plate can be manually or automatically corrected by suitably adjusting the hydraulic pressure in one or more of the cylinders 89 and 90. The cylinders may be set for pass reductions compatible with such factors as the metal of the workpiece, the power available to drive the work rolls 81 through 84, heat distribution and the like. The work roll pressure does not need to be altered from pass-to-pass until close to the finishing pass, where it is reduced. The most important factor to be observed is the ratio of the surface velocities of the two pairs of work rolls 81–82 and 83–84, and that ratio must be reversed each time the rolling direction is reversed. This sequence, as well as the feeding of the workpiece 91 into the roll bite, is preferably done automatically.

Modifications may be made in the invention without departing from the spirit of it.

What is claimed is:

1. A mill for rolling flat workpieces, such as plates, sheets, strips and the like, from plastically deformable material, said mill comprising two housings, an upper and a lower backing beam each having its ends attached to said housings, an upper and a lower work roll supported by said upper and lower backing beams respectively, means maintaining the axes of said upper and lower work rolls in the same vertical plane, and means operatively connected to said rolls for rotating said upper and lower work rolls in opposite directions, a plurality of roller-carrying pressure transmitting elements for each of said upper and lower work rolls, the pressure transmitting elements for each roll being disposed between said roll and the adjacent one of said backing beams, each of said pressure transmitting elements of each roll being individually attached to said adjacent backing beam, said pressure transmitting elements of each work roll being evenly spaced along the face of their respective work roll with their rollers in operating contact with adjacent sectors of their respective work roll, said pressure transmitting elements for said upper work roll and said lower work roll being equal in number and opposed, each of said pressure transmitting elements of at least one of said upper and lower work rolls having individually controllable fluid pressure means connected thereto, said pressure transmitting elements transmitting rolling pressure to said sectors of said at least one work roll through said individually controllable fluid pressure means.

2. The rolling mill claimed in claim 1 wherein said upper and lower work rolls are located in chocks slidably mounted in said housings, said chocks maintaining the axes of said work rolls in a single vertical plane.

3. The rolling mill claimed in claim 1 wherein each of said individually controllable fluid pressure means comprises a fluid cylinder and a piston, each of those roller-carrying pressure transmitting elements provided with a fluid pressure means being affixed to said piston thereof and means controlling the fluid pressure within said cylinder of each said fluid pressure means.

4. The rolling mill claimed in claim 1 wherein said upper and lower work rolls comprise a first pair thereof, a second pair of upper and lower work rolls provided in said mill, means maintaining the axes of said upper and lower work rolls of said second pair in the same vertical plane parallel to and spaced from said vertical plane in which the axes of said first pair of work rolls are located, a plurality of roller-carrying pressure transmitting elements for each of said upper and lower work rolls of said second pair, the pressure transmitting elements for each roll of said second pair being disposed between said roll and the adjacent one of said upper and lower backing beams and being individually attached to said adjacent backing beams, said pressure transmitting elements of each work roll of said second pair being evenly spaced along the face of their respective work roll with their rollers in operating contact with adjacent sectors of their respective work roll, said pressure transmitting elements of said upper and said lower work rolls of said second pair being equal in number and opposed, each of said pressure transmitting elements of at least one of said upper and lower work rolls of said second pair having individually controllable fluid pressure means connected thereto, said pressure transmitting elements transmitting rolling pressure to said sectors of said at least one work roll of said second pair through said individually controllable fluid pressure means, rigidly correlated drive means operatively connected to said work rolls for driving both pairs of said work rolls and for accurately controlling the surface velocities of said two pairs of work rolls maintaining that portion of a workpiece extending therebetween under tension.

5. The rolling mill claimed in claim 1 wherein each of said pressure transmitting elements comprises an endless chain of rollers and an arcuate anvil, said endless chain of rollers being mounted on said anvil for rotation thereabout, support means for said anvil, said support means of each of said pressure transmitting elements provided with said individually controllable fluid pressure means being affixed to its respective fluid pressure means, the support means of the remainder of said pressure transmitting elements being affixed to an adjacent backing beam of said mill.

6. The rolling mill claimed in claim 1 wherein each of said pressure transmitting elements comprises a bracket supporting first and second shafts in parallel spaced relationship, a single bearing rotatively mounted on said first shaft and a pair of bearings rotatively mounted on said second shaft, said bracket of each of said pressure transmitting elements provided with said individually controllable fluid pressure means being affixed to its respective fluid pressure means, the bracket of the remainder of said pressure transmitting elements being affixed to an adjacent backing beam of said mill, each pressure transmitting element for each of said upper and lower work rolls having its single bearing located to one side of the axis of its respective work roll and its pair of bearings located to the other side of said last mentioned axis and being off center with respect to said last mentioned axis to equalize the forces exerted by said bearings on either side of said work roll, adjacent pressure transmitting elements located along the faces of said upper work roll and said lower work roll having their single bearings on opposite sides of their respective work roll.

7. The rolling mill claimed in claim 3 wherein said means for each cylinder for controlling the fluid pressure therein comprises a source of fluid under pressure, a tank, an accumulator, and a valve, said valve having a first position closing off said cylinder and accumulator from said source of fluid under pressure and said tank, said valve having a second position connecting said cylinder and said accumulator to said source of fluid under pressure, said valve having a third position connecting said cylinder and said accumulator to said tank, said valve having actuator means for obtaining opening periods of controllable duration of several milliseconds.

8. The rolling mill claimed in claim 4 wherein said upper beam extends parallel to and above said upper work rolls of said first and second pairs, said lower beam extending parallel to and below said lower work rolls of said first and second pairs, said upper and lower work rolls of each of said pairs being located in chocks slidably mounted in said housing assemblies, said chocks maintaining the axes of said work rolls of each of said pairs in a single vertical plane.

9. The rolling mill claimed in claim 4 wherein said drive means is reversible.

10. The rolling mill claimed in claim 4 wherein said drive means incorporates a gear arrangement comprising a sun gear, a plurality of satellite gears surrounding and meshing with said sun gear and supported on a spider means, an internally toothed ring gear surrounding and meshing with said satellite gears, said ring gear being provided with external teeth, a gear motor having a shaft and a worm gear, said worm gear being meshed with said external teeth of said ring gear, said first pair of upper and lower work rolls being operatively connected to said sun gear, said second pair of upper and lower work rolls being operatively connected to said satellite gears, said ring gear when stationary fixing the ratio of angular velocities of said sun and satellite gears, said ring gear precisely changing and maintaining said changed ratio when rotated by said gear motor and worm gear at a constant selected speed.

11. The rolling mill claimed in claim 5 wherein each roller of each chain of rollers comprises a plurality of roller segments mounted on a shaft, the shafts of adjacent rollers being joined together by thin spring steel links, the outermost ends of the outermost roller segments being slightly tapered.

12. The rolling mill claimed in claim 5 wherein one end of each of said anvils is provided with driven means for driving said roller chain mounted thereon, said roller chain comprising a traction transmitting roller chain transmitting substantial traction to its respective one of said work rolls.

13. A mill for rolling flat workpieces, such as plates, sheets, strips and the like, from plastically deformable material, said mill comprising two housings, an upper and a lower backing beam each having its ends attached to said housings, an upper and a lower work roll, said upper and lower work rolls being free floating, a pair of upper backup rolls for said upper work roll located in chocks slidably mounted in said housings, a pair of lower backup rolls for said lower work roll located in chocks slidably mounted in said housings, said pairs of backup rolls maintaining the axes of said work rolls in a single vertical plane, a plurality of roller-carrying pressure transmitting elements for each of said upper and lower work rolls, said pressure transmitting elements for said upper work roll being located between said upper pair of backup rolls and said upper beam, each of said pressure transmitting elements for said upper work roll being individually attached to said upper beam, said pressure transmitting elements for said upper work roll being evenly spaced along the faces of said upper backup rolls with their rollers in operating contact with adjacent sectors of both of said upper backup rolls, said pressure transmitting elements for said lower work roll being located between said lower pair of backup rolls and said lower beam, each of said pressure transmitting elements for said lower work roll being individually attached to said lower beam, said pressure transmitting elements for said lower work roll being evenly spaced along the faces of said lower backup rolls with their rollers in operating contact with adjacent sectors of both of said lower backup rolls, said pressure transmitting elements for said upper work roll and said lower work roll being equal in number and opposed, each of said pressure transmitting elements of at least one of said upper and lower work rolls having individually controllable fluid pressure means connected thereto, said pressure transmitting elements transmitting rolling pressure to said sectors of their respective pair of backup rolls through said individually controllable fluid pressure means.

14. The rolling mill claimed in claim 13 wherein each of said pressure transmitting elements comprises an endless chain of rollers and an arcuate anvil, said endless chain of rollers being mounted on said anvil for rotation thereabout, support means for said anvil, said support means of each of said pressure transmitting elements provided with individually controllable fluid pressure means being affixed to its respective fluid pressure means, said support means for the remainder of said pressure transmitting elements being affixed to an adjacent backing beam, said anvil of each of said pressure transmitting elements being so configured that the endless chain of rolls mounted thereon contacts part of the peripheries of the backup rolls of its respective pair thereof.

15. A method of rolling flat workpieces of plastically deformable material comprising the steps of providing a rolling mill, providing upper and lower work rolls in said mill, providing a pair of mill housings, joining said mill housings by an upper beam located above and parallel to said upper work roll and lower beam located below and parallel to said lower work roll, maintaining the axes of said rolls in a vertical plane, driving said work rolls in opposite directions, passing said workpieces between said rolls, providing each work roll with a plurality of roller-carrying pressure transmitting elements evenly spaced along its face, said pressure transmitting elements for said upper and lower work rolls being equal in number, opposed and with the rollers of each contacting a sector of the periphery of its respective work roll, locating said pressure transmitting elements for said upper work roll between said upper work roll and said upper beam, operatively attaching said last mentioned pressure transmitting elements to said upper beam, locating said pressure transmitting elements for said lower work roll between said lower work roll and said lower beam, operatively attaching said last mentioned pressure transmitting elements to said lower beam, providing individually controllable fluid pressure means for each of said pressure transmitting elements of at least one of said work rolls, and transmitting rolling pressure to said at least one work roll solely from said individually controllable fluid pressure means, each of said individually controllable pressure means comprising a fluid cylinder and a piston, and attaching said cylinder to the adjacent one of said upper and lower beams and said pressure transmitting element to said piston.

16. The method claimed in claim 15 including the steps of maintaining the pressure of said fluid pressure means of those pressure transmitting elements located within the width of said workpiece at an even value, maintaining the pressure of said fluid pressure means of those pressure transmitting elements located only partly within the width of said workpiece at a lesser value than those located within the workpiece width, and maintaining the pressure of said fluid pressure means of those pressure transmitting elements located outside the width of said workpiece at zero.

17. The method claimed in claim 15 wherein said upper and lower work rolls comprise a first pair, and including the steps of providing a second pair of upper and lower work rolls, with said upper beam extending parallel to and above said upper work roll of said second pair, and said lower beam extending parallel to and below said lower work roll of said second pair, providing each work roll of said second pair with a plurality of roller-carrying pressure transmitting elements evenly spaced along its face, said pressure transmitting elements for said upper and lower work rolls of said second pair being equal in number, opposed and with the rollers of each contacting a sector of the periphery of its respective work roll, locating said pressure transmitting elements for said upper work roll of said second pair between said upper work roll of said second pair and said upper beam, operatively attaching said last mentioned pressure transmitting elements to said upper beam, locating said pressure transmitting elements for said lower work roll of said second pair between said lower work roll of said second pair and said lower beam, operatively attaching said last mentioned pressure transmitting elements to said lower beam, providing individually controllable fluid pressure means for each of said pressure transmitting elements of at least one of said rolls of said second pair, and transmitting rolling pressure to said at least one work roll of said second pair solely from said individually controllable fluid pressure means, each of said individually controllable pressure means comprising a fluid cylinder and a piston, and attaching said cylinder to the adjacent one of said upper and lower beams and said pressure transmitting element to said piston, driving said rolls of said second pair in opposite directions, passing said workpieces between said rolls of said first and second pairs, and controlling the surface velocities of said two pairs of rolls such that the portion of a workpiece extending therebetween is maintained under tension.

18. The method claimed in claim 17 wherein each of said roller-carrying pressure elements comprises an anvil having a cavity surrounding part of the periphery of a sector of its respective work roll, said anvil being surrounded by an endless roller chain rotating thereabout.

19. The method claimed in claim 18 including the step of driving said roller chain of each pressure element about its respective anvil.

* * * * *